US006487761B2

(12) United States Patent
Van Tassel

(10) Patent No.: US 6,487,761 B2
(45) Date of Patent: Dec. 3, 2002

(54) QUICK RELEASE BUCKLE FOR DIVERS

(76) Inventor: Charles E. Van Tassel, 15115 Eastvale Rd., Poway, CA (US) 92064

( * ) Notice: Subject to any disclaimer, the term of this patent is extended or adjusted under 35 U.S.C. 154(b) by 0 days.

(21) Appl. No.: 09/761,794

(22) Filed: Jan. 17, 2001

(65) Prior Publication Data

US 2002/0092140 A1 Jul. 18, 2002

(51) Int. Cl.[7] ..... A44B 11/00; A44B 17/00

(52) U.S. Cl. ..... 24/606; 24/616; 24/625; 24/647; 24/664

(58) Field of Search ..... 24/606, 664, 616, 24/597, 647, 3.4, 163 K; 119/14.1, 865

(56) References Cited

U.S. PATENT DOCUMENTS 1,091,449 A * 3/1914 Westin ..... 24/647
2,522,790 A * 9/1950 Johnston ..... 24/647
2,964,937 A * 12/1960 Lautin ..... 24/647
3,200,463 A * 8/1965 Craven et al. ..... 24/647
4,825,515 A 5/1989 Wolterstorff, Jr.
4,831,694 A * 5/1989 Kong ..... 24/625
5,222,279 A 6/1993 Frano et al.
5,440,792 A * 8/1995 Ida ..... 24/615
5,465,472 A * 11/1995 Matoba ..... 24/625
5,832,573 A 11/1998 Howell
6,076,237 A * 6/2000 Goorhouse ..... 24/616
6,145,172 A * 11/2000 Bourdon ..... 24/625
6,154,936 A 12/2000 Howell

* cited by examiner

*Primary Examiner*—Victor Sakran
(74) *Attorney, Agent, or Firm*—Boniard I. Brown

(57) ABSTRACT

A buckle apparatus for rapid disengagement of male and female members has deformable portions of a male pull member extending into the female member and retained in openings of the female member. An elongate pull element extends from the deformable portion or portions for pulling thereon to deform the deformable portions to disengage the male and female members.

20 Claims, 5 Drawing Sheets

QUICK RELEASE BUCKLE FOR DIVERS

BACKGROUND AND SUMMARY OF THE INVENTION

A person under water may typically wear a jacket with compensating equipment to adjust the effective weight of the person in the water to control depth or to enable the person to rise in the water when desired or necessary. A weight belt often used to aid in achieving neutral buoyancy typically comprises a belt having thereon pouches containing weights. Weights can also be carried in pockets on such jackets.

Persons engaged in underwater activities often utilize a buoyancy compensator arrangement with an inflatable bladder, or the like, for buoyancy trim or compensation. Such a bladder is inflatable orally or by a container of compressed gas in the jacket worn by the person. To rise up in the water, the tank is filled with air and when it is desired to lower the person in the water, air is released by a valve. Weights are often disposed in pockets attached to such a jacket for the release of the weights to enable the person to rise through the water.

A person must be able to release the weights quickly when desired or necessary. In underwater emergencies, it is vital that the weights be quickly releasable at a proper time so that the weights may drop away to give more buoyancy to the person. Quick-release systems or arrangements have heretofore been utilized, including bottom-opening pockets containing weights, and openable to drop the weights. Such an arrangement involves the desirability or necessity that the person be generally vertically oriented. Present prior art weight-release arrangements involve a person wearing a jacket whereon weights are provided in a pouch or pouches. To release the weights, a person pulls on such a pocket and separates Velcro fasteners to release the pocket from the jacket. This arrangement has the shortcoming that Velcro fasteners become weak or ineffective when under water, so that the Velcro fasteners do not work well, and the weights tend to fall out at an inappropriate time and are lost.

Upon the weights falling out from the pockets, the person rises up in the water undesirably or accidentally. Such rapid rising causes air in the lungs to expand rapidly, thus putting pressure on blood vessels to cause possible internal bleeding and ear problems, or worse results.

When wearing relatively heavy gloves under water, particularly cold water, a person cannot readily squeeze the sides of a buckle for disengagement of male and female buckle members. A person may drown while endeavoring to open a buckle, thus resulting in possible lawsuits and complications.

It is desirable or necessary that the weights do not fall out and drop away until the appropriate moment at which the person desires or it is necessary for the person to release them. Under dangerous circumstances, it should not be necessary for the person to reach, grasp the buckle to squeeze side arms of a male member, then reach across to grasp a weight pocket or pouch, then pull the buckle members apart. Without going through such steps, a person loses the entire weight pocket or pockets, and thus loses control of the rising process.

The present invention provides a quick-release or disengagement buckle apparatus wherein a male buckle having at least one deformable portion is retained in a female pull opening to retain the members together, and an elongated pull element extends from the deformable portion for manual pulling thereof to disengage the male member from the female member. The at least one or preferably two deformable protuberances comprise at least one spring arm adapted to engage in a lateral opening of the female member to retain the members together, and the members are disengageable by pulling on the elongated pull element to deform the deformable protuberances element or elements to deform them to disengage the male and female members from each other.

DESCRIPTION OF THE PREFERRED EMBODIMENTS

Figure 1A:
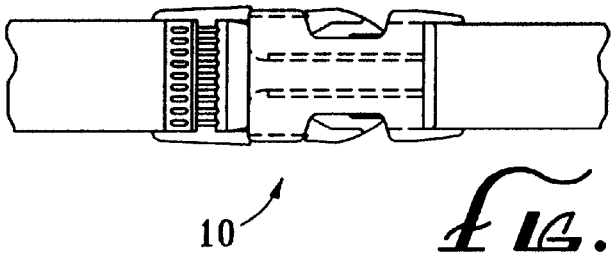
FIG. 1A PRIOR ART
FIGS. 1A to 1D show prior art buckle assemblies in assembled relation and separated.
Figure 1B:
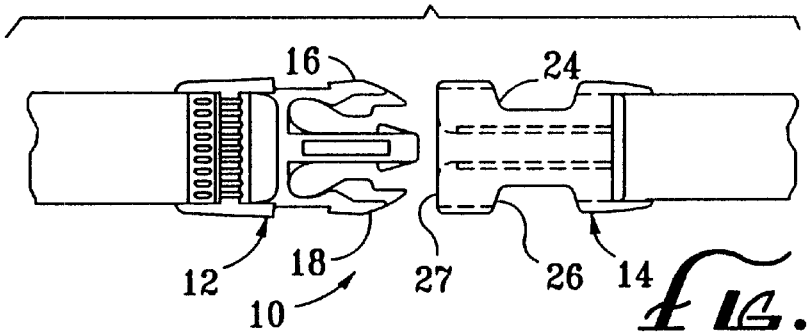
FIG. 1B PRIOR ART
Figure 1C:
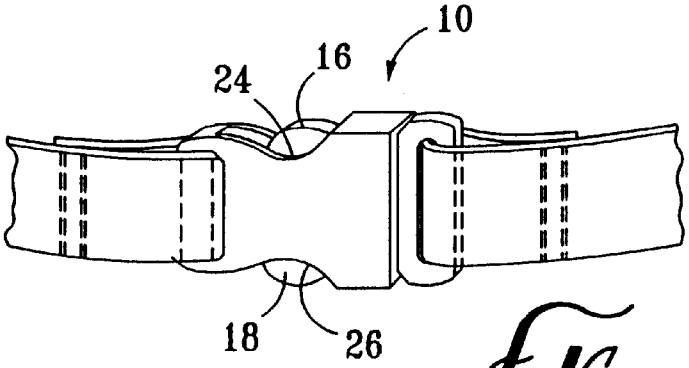
FIG. 1C PRIOR ART
Figure 1D:
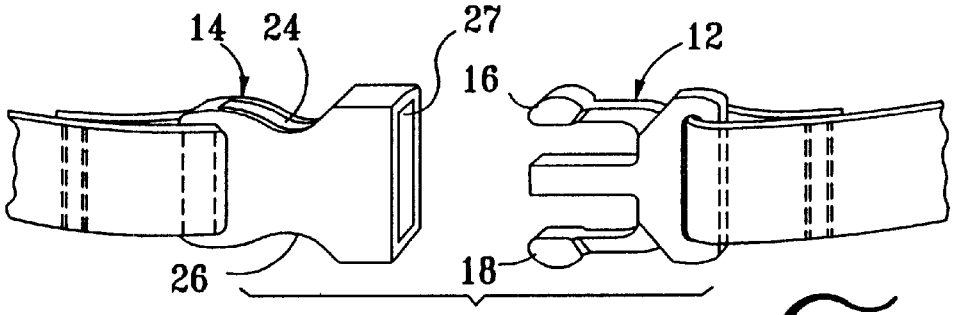
FIG. 1D PRIOR ART
Figure 2A:
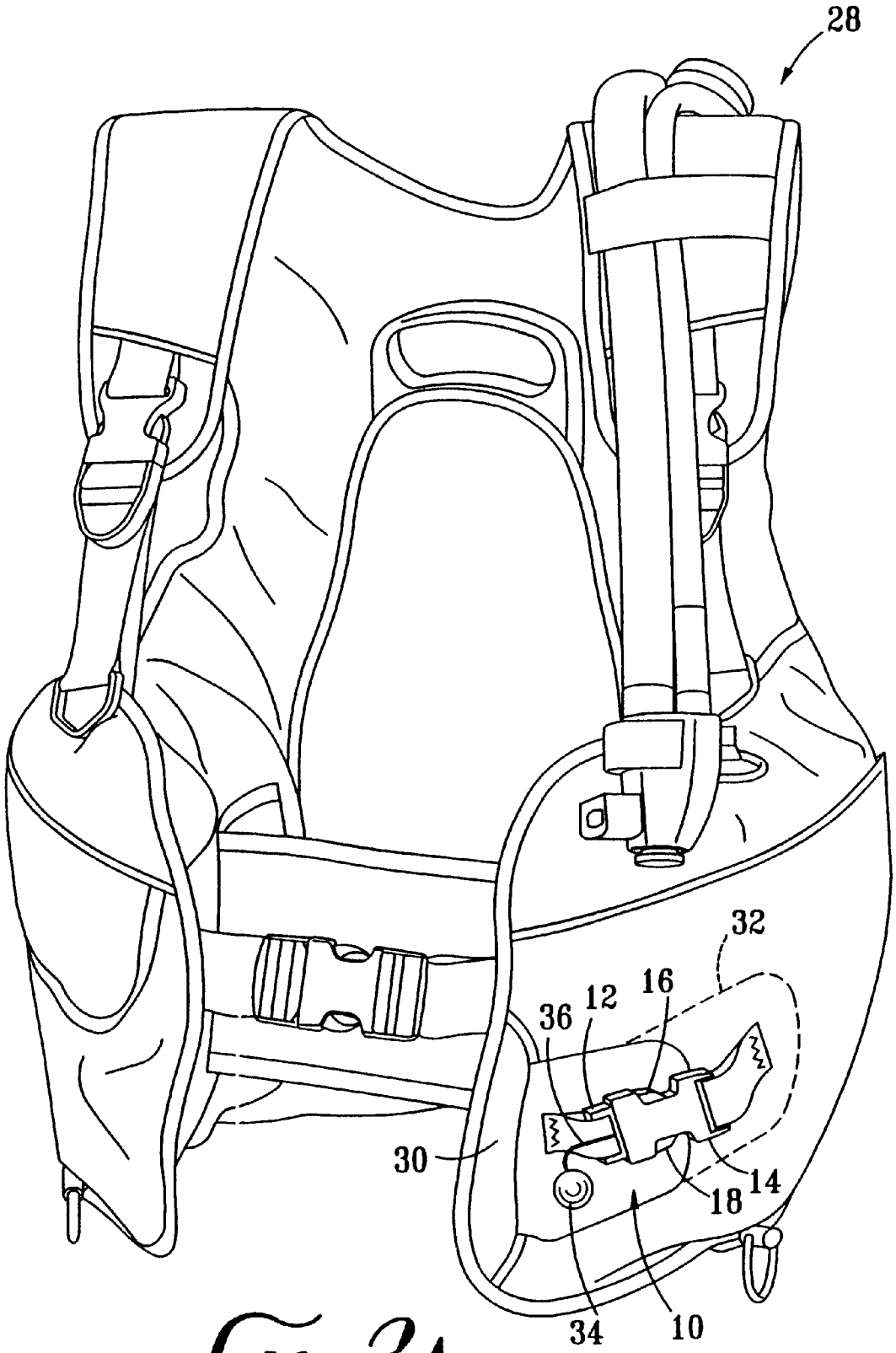
FIG. 2A shows a generally conventional jacket for underwater use with the buckle assembly of the present invention thereon.
Figure 2B:
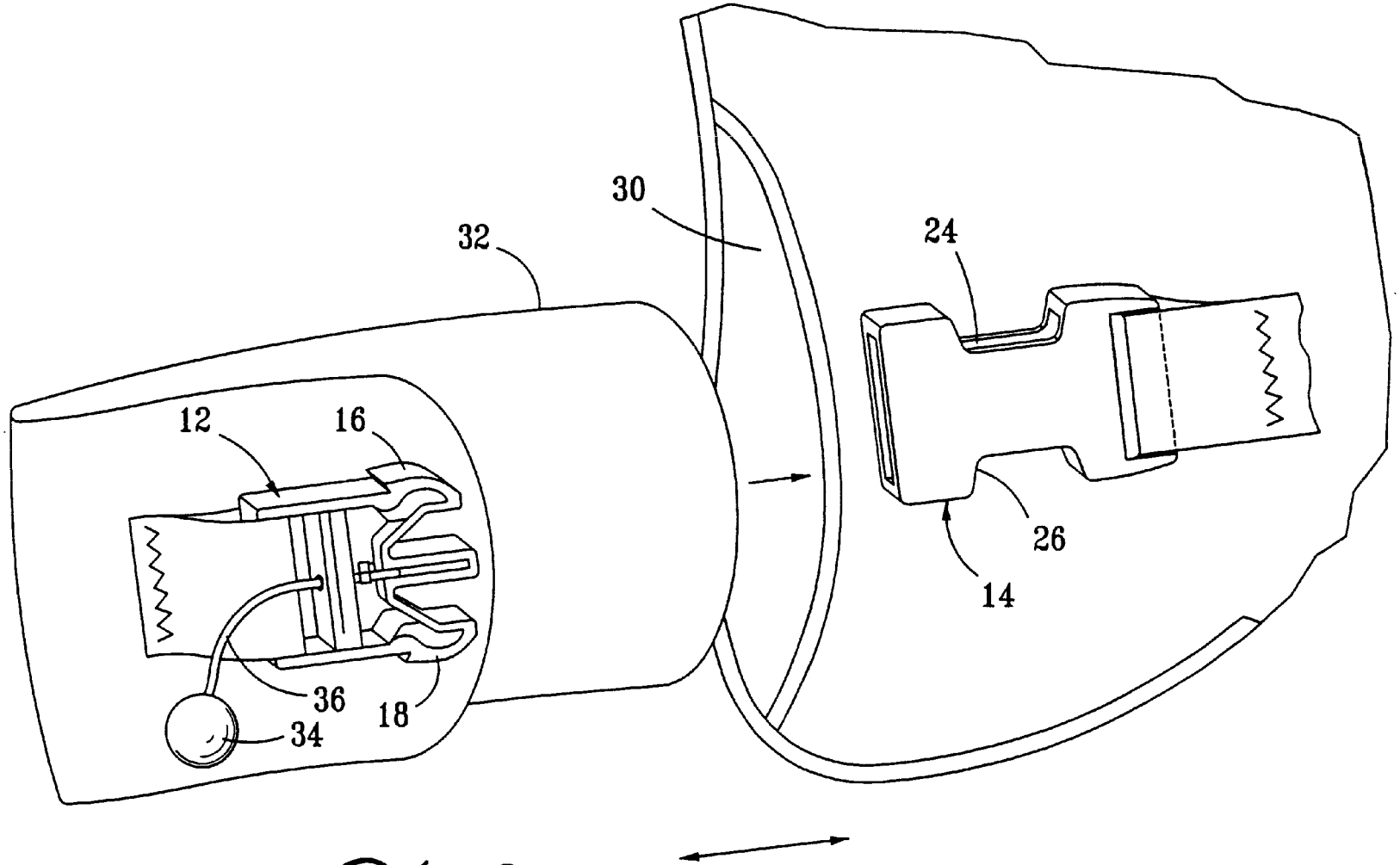
FIG. 2B is an enlarged partial view showing components of the buckle assembly mounted on the jacket of FIG. 2 with members thereof disengaged.

The present invention relates to a quick-release arrangement for buckles such as those used in under-water activities such as scuba diving, back-packing, and climbing, where a need or emergency may quickly arise requiring disengagement of a buckle.

Although the invention is applicable to a number of other types of buckles, typical buckles for use with the invention are shown in FIGS. 1A to 1D of the drawings. Such buckles are described in U.S. Pat. No. 5,222,279 to Frano et al., and U.S. Pat. No. 4,825,515 to Wolterstorff, Jr.

According to the drawings, buckle 10 comprises a male member 12 and a female member 14. The male member has deformable spring arms 16, 18 extending outwardly from a tongue support. The tongue supports are adapted to deform or to flex upon application of lateral pressure digitally on the arms. The spring arms preferrably comprise protuberances having concave, hooked end portions.

Such buckles are preferrably fabricated of hard plastic, such as Velcron, which has a spring characteristic, and which can withstand long, repeated use.

Engagement of the male and female members to secure the buckle is effected by the spring arms 16, 18 of the male member extending laterally outwardly through opposite lateral openings 24, 26 in the female member, after the male member spring arms are inserted through an end opening 27 in the female member. The spring arms or protuberances have inclined surfaces to cam the spring arms inwardly during insertion into the female member. The female member has guidance components effecting securement together of the members.

Disengagement of the male member from the female member is effected by digital lateral pressure on the spring arms 16, 18 extending outwardly from lateral openings 24, 26 of the female member. Squeezing the spring arms inwardly disengages the spring members from edge portions of the female member openings.

According to the present invention, the female member is sewn or otherwise secured to an outer wall of a jacket 28 and over a pocket 30 wherein is disposed a pouch 32 containing a weight or weights (not shown). The male member 12 of the buckle is sewn or otherwise secured to the weight pouch 32, as shown. The buckle thus serves to retain the weight pouch in place. Conventionally, the weight pouch is attached by a Velcro fastener arrangement, with one member having mating Velcro hook elements and the other member having Velcro loop elements (not shown).

A knob 34 is attached by an elongate cord 36 to the male member. The knob may be connected with the male member by a flat woven web, or a relatively rigid rod member, etc, (not shown).

Figure 3:
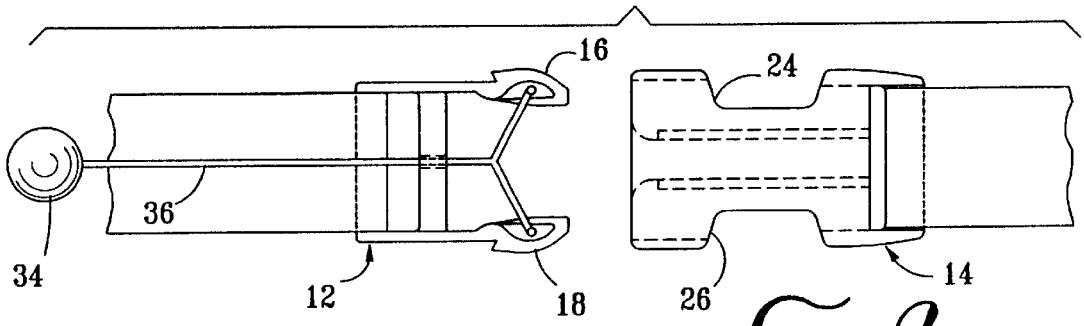
FIG. 3 shows a modified form of the present invention in relation to buckle components somewhat similar to those of FIGS. 1 and 2.
Figure 4:
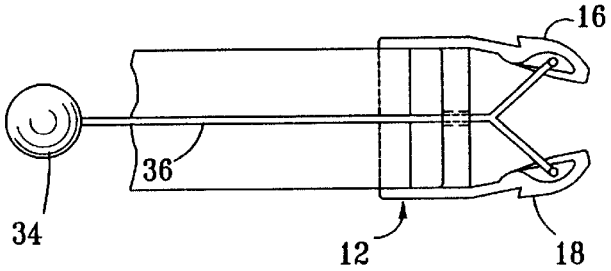
FIG. 4 shows a male component of the embodiment of FIG. 3 with deformable members retracted according to the invention.
Figure 5:
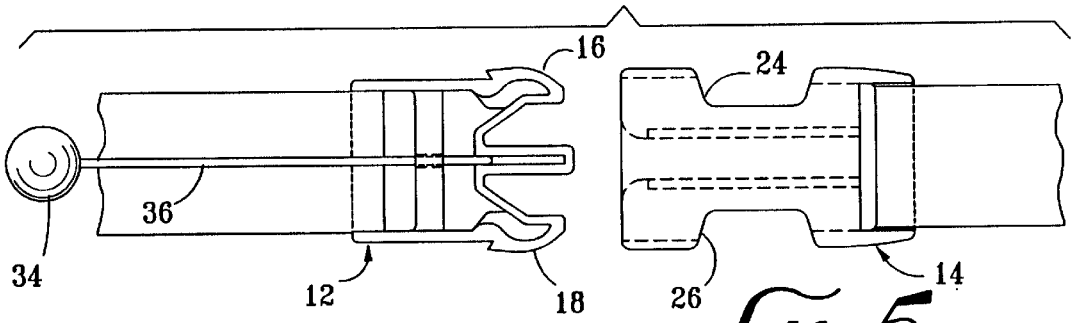
FIG. 5 shows another modified form of the invention with modified male member features.
Figure 6:
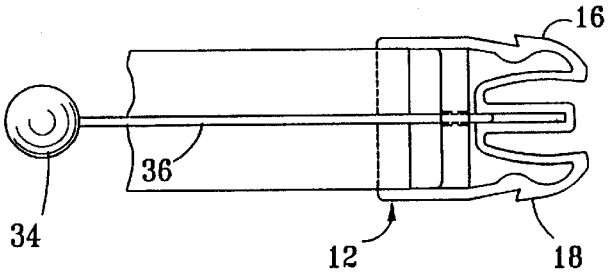
FIG. 6 shows the male member of FIG. 5 with deformable members retracted according to the invention.
Figure 7A:
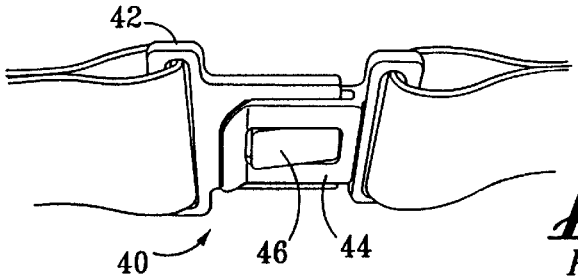
FIG. 7A PRIOR ART
FIGS. 7A and 7B show a prior art buckle assembly with which a second embodiment of the invention is utilized.
Figure 7B:
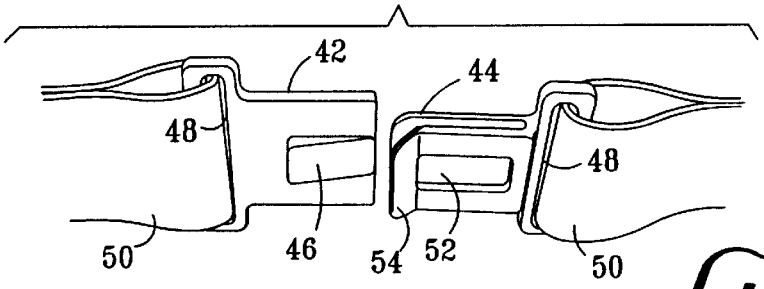
FIG. 7B PRIOR ART
Figure 9A:
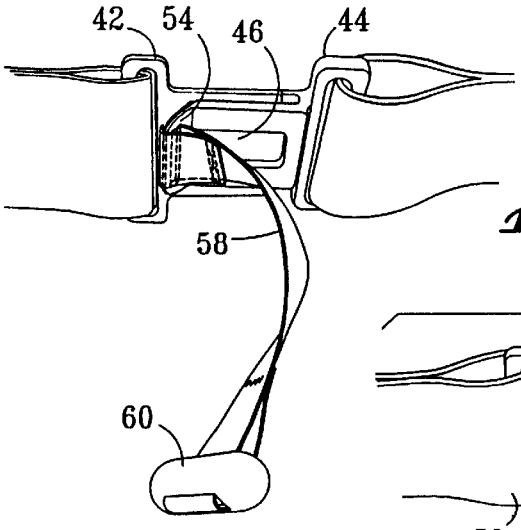
FIGS. 9A and 9B show a buckle assembly according to the invention incorporating the buckle assembly of FIG. 7B in modification of FIG. 8 and an elongated pull element, according to the invention.
Figure 9B:
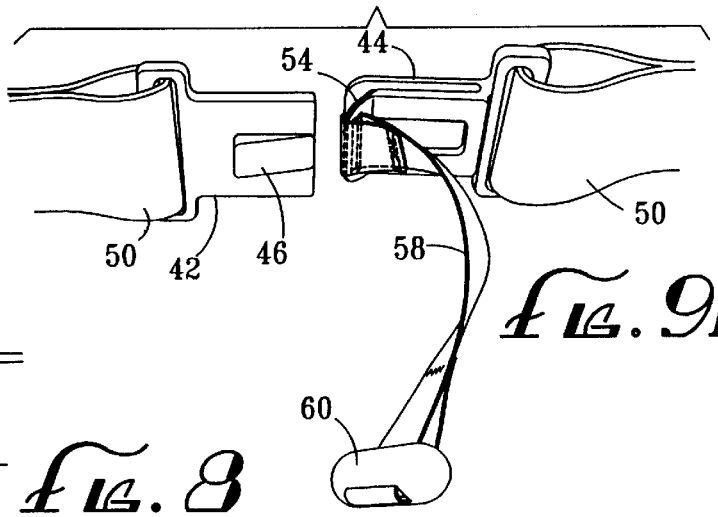
Figure 8:
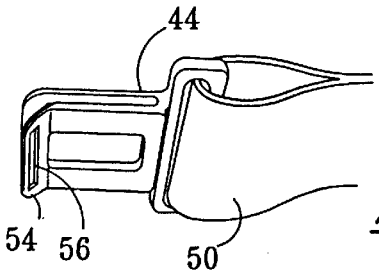
FIG. 8 shows a female member of the buckle assembly of FIGS. 7A and 7B with a lock in a female member thereof according to the invention.

Manual pulling of the knob urges spring arms 16, 18 toward each other to disengage together as indicated in FIG. 4, thus to disengage the spring arms from edge portions of the lateral openings 24, 26 in the female member (FIGS. 3 and 4).

The conventional requirement that manual pressure be applied on the spring arms 16, 18 to disengage them from the female member openings, is eliminated. With the male member disengaged from the female member simply by pulling on the knob and cord, the pouch on which the male member is secured, is pulled from the jacket pocket. The person then can hold the pocket in hand until the appropriate moment for releasing the pouch to enable the person to rise through the water by thus reducing the overall weight. The weights may be readily released at an appropriate moment, either by dropping the entire pouch or dropping certain of the weights in the pouch.

It is usually desirable that a person under water retain or hold the weight pouch in his hand or hands until the appropriate moment for dropping the weights and the person rising through the water. However, in certain emergencies, a person must drop the weights and pouch immediately upon pulling the knob to remove the pouch from the jacket pocket.

The quick, automatic removal of the pouch and weights from the jacket pocket, according to the invention, is much faster and more positive than the conventional squeezing together of the male spring arms, which is difficult if not impossible to accomplish while underwater, particularly under dangerous conditions and/or while wearing heavy gloves.

FIGS. 7A–9B illustrate a second form of the invention. A buckle assembly 40 comprises a male member 42 and a female member 44, each having a transverse slot 48 therein to receive opposite end portions of a belt 50, as shown. The male member has a laterally extending deformable spring portion 46 extending laterally inclined relative to the main portion of the male member, and deformable inwardly toward the main portion. The inclined portion 46 is adapted for insertion into a slot 52 defined in the female member, and to extend laterally outwardly to engage an inclined end portion 54 of the female member to retain the male member relative to the female member.

An end portion of a web strap 58 is secured in a slot 56 of the female member (FIGS. 8 and 9A), and a knob 60 is attached at the outer end of the web strap.

Manual pulling on the knob 60 deforms portion 54 of the female member to disengage the male member portion 46 therefrom, as will be understood from the geometry of the parts, thus to open the buckle to free the strap end portions.

It will be understood that various changes and modifications may be made from the preferred embodiments discussed above without departing from the scope of the present invention, which is established by the following claims and equivalents thereof.

What is claimed is:

1. A buckle apparatus for rapid disengagement of buckle components, comprising:

a female buckle member having side walls defining an opening to receive a male buckle member and having one of said side walls being deformable, said deformable side wall having a slot formed therein, a male buckle member having a deformable tab portion adapted to extend through and to be retained in said female buckle slot to retain the male and female members together, and an elongated pull element attached to and extending from said deformable side wall for manual pulling thereon to deform said side wall to disengage said deformable tab portion from said slot and to further disengage the male member from the female member.

2. A buckle apparatus according to claim 1, wherein said pull element is attached at an opening-in an inclined portion of said one of the said side walls of the female member.

3. A buckle apparatus according to claim 1, wherein said pull element is attached to a deformable end portion of the female member side wall, and the female member has a slot defined in one of said side walls.

4. A buckle apparatus according to claim 3, wherein said sidewall/deformable end portion of the female member side wall is a bent side wall portion deflected by pulling on said elongated pull element to disengage the male member deformable portion relative to said female buckle opening.

5. A buckle apparatus according to claim 1, wherein the elongated pull element is secured in a slot in an end portion of the female member for deflection of the end portion by pulling on the elongated element to deform the end portion to disengage it from the male member deformable portion.

6. A buckle apparatus according to claim 2, wherein said deformable side wall of the female member has a bent end portion deflected by pulling on said elongated pull element to disengage the male member relative to said female buckle opening.

7. A buckle apparatus according to claim 3, wherein:

said tab portion which is extended into the female member slot, and extends laterally outwardly through the female member slot to retain the male and female members together.

8. A buckle apparatus for rapid disengagement of members thereof, comprising:

a female member having an entry opening and at least one lateral opening, a male member having at least one deformable protuberance portion adapted to extend into said end opening of the female member and to extend outwardly through said at least one lateral opening of the female member to retain the members together, the male member being disengageable from the female member by depression of said at least one male deformable portion to exit the female member via the female member end opening, and an elongated pull element connected with the at least one male member protuberance for manual pulling thereon to deform and urge inwardly the male member protuberance to disengage the male and female members from each other.

9. A buckle apparatus according to claim 8, wherein said female member has a generally flattened tubular configuration.

10. A buckle apparatus according to claim 8, wherein said at least one deformable protuberance is a spring arm adapted to engage in the lateral opening of the female member to retain male and female members together.

11. A buckle apparatus according to claim 8, wherein the at least one male protuberance extends only partially outwardly of said female member opening.

12. A buckle apparatus according to claim 8, wherein the elongated pull element is one of (a) a cord, (b) a web, (c) a rod.

13. A buckle apparatus for rapid disengagement of members thereof, comprising:

a female member having an end opening and having lateral openings at opposite sides thereof, a male member having two oppositely disposed deformable protuberances engageable in opposite lateral openings of the female member to releasably retain together the male and female members, said male deformable protuberances being manually deformable inwardly of the female member via said lateral openings to disengage the male and female members, and an elongated pull element connected with the male deformable protuberances for manual pulling to deform inwardly the male member protuberances relative to the female member lateral openings to disengage the male and female members from each other.

14. A buckle apparatus according to claim 13, wherein said female member has a generally flattened tubular configuration.

15. A buckle apparatus according to claim 13, wherein said deformable protuberances are spring arms adapted to engage in the lateral openings of the female member to retain male and female members together.

16. A buckle apparatus according to claim 13, wherein the female member lateral openings are disposed in opposite respective sides thereof.

17. A buckle apparatus according to claim 13, wherein the male protuberances extend only partially outwardly of said female member opening.

18. A buckle apparatus according to claim 13, wherein the elongated pull element is one of (a) a cord, (b) a web, (c) a rod.

19. A buckle apparatus for rapid disengagement of members thereof, comprising:

a female member having an end opening and having lateral openings at opposite sides thereof, a male member having two oppositely disposed deformable protuberances engageable in opposite lateral openings of the female member to releasably retain together the male and female members, said male deformable protuberances being manually deformable inwardly of the female member via said lateral openings to disengage the male and female members, an elongate pull element connected with the male deformable protuberances for manual pulling to deform inwardly the male member protuberances relative to the female member lateral openings to disengage the male and female members from each other, and said elongate element having bifurcated end portions, one end portion being connected with a respective one of the male deformable protuberances to deform the spring arms inwardly of the female member lateral openings.

20. A buckle apparatus according to claim 19, wherein said male member comprises integral interconnecting features engaging the elongate element and connected with the deformable protuberances to deform the protuberances inwardly of the female member lateral opening upon the pulling of the elongate pull element.

* * * * *